US006009950A

United States Patent [19]

Cunningham et al.

[11] Patent Number: 6,009,950

[45] Date of Patent: Jan. 4, 2000

[54] SUBSEA MANIFOLD STAB WITH INTEGRAL CHECK VALVE

[75] Inventors: Michael Thomas Cunningham, Plantersville; James L. Dean, Spring, both of Tex.

[73] Assignee: Oceaneering International, Inc., Houston, Tex.

[21] Appl. No.: 09/035,168

[22] Filed: Mar. 5, 1998

Related U.S. Application Data

[60] Provisional application No. 60/040,201, Mar. 6, 1997.

[51] Int. Cl.[7] ..... E21B 34/04

[52] U.S. Cl. ..... 166/344; 166/347

[58] Field of Search ..... 166/344, 347, 166/339, 340, 325, 332.7

[56] References Cited

U.S. PATENT DOCUMENTS

| | | | |
|---|---|---|---|
| 4,456,070 | 6/1984 | Watkins | 166/345 |
| 4,457,489 | 7/1984 | Gilmore | 166/344 X |
| 4,848,472 | 7/1989 | Hopper | 166/344 |
| 4,878,783 | 11/1989 | Baugh | 166/344 X |
| 4,949,938 | 8/1990 | Ekman . | |
| 5,088,558 | 2/1992 | Mohn | 166/339 |
| 5,738,172 | 4/1998 | Van Mook et al. | 166/344 |

FOREIGN PATENT DOCUMENTS

| | | |
|---|---|---|
| 2 231 642 | 11/1990 | United Kingdom . |
| 2 293 221 | 3/1996 | United Kingdom . |
| WO 92/06272 | 4/1992 | WIPO . |

*Primary Examiner*—Frank Tsay
*Attorney, Agent, or Firm*—Duane, Morris & Heckscher, LLP

[57] ABSTRACT

A stab for a gas-lift injection line is disclosed which includes a built-in check valve to exclude seawater as the stab is being delivered to the subsea manifold. The check valve can be a spring-loaded poppet which can be pressure-balanced with the surrounding hydrostatic forces, or alternatively, preloaded with the use of a pressurized chamber working in conjunction with a biasing spring to hold the check valve in the closed position during delivery. After insertion of the stab into the subsea manifold, the gas flow begins in the stab, which overcomes the forces of the spring and/or pressurized compartment to push the check valve into the open position to allow gas-lift flow through the manifold and down the annulus into the gas-lift valves in the well. Bypass flow passages are incorporated into the plug to provide an additional force to hold the plug in the open position once the gas-lift pressure is applied so as to prevent chattering of the check valve component in the stab.

21 Claims, 3 Drawing Sheets

SUBSEA MANIFOLD STAB WITH INTEGRAL CHECK VALVE

This Application claims the benefit of U.S. Provisional Application Ser. No. 60/040,201 filed Mar. 6, 1997.

FIELD OF THE INVENTION

This field of this invention relates to manifolds for subsea use, particularly manifold stabs with an integral check valve for use in gas-lift operations.

BACKGROUND OF THE INVENTION

In some subsea wells, when the formation pressure is no longer sufficient to produce hydrocarbons, a technique called "gas lift" is employed to stimulate further production from the low-pressure formation. The gas-lift technique involves pumping, under pressure, gas into the annulus which enters the production string through gas-lift valves. The presence of gas in the tubing string reduces the weight of the column of fluid in the production string and allows the remaining formation pressure to move the hydrocarbons to the surface. Subsea wells that have their manifolds with access to the annulus installed below the waterline require connections, generally with divers or remotely operated vehicles (ROVs) in order to place the well on gas-lift service. For wellheads at substantial depths, the use of divers becomes impractical and the currently practical solution is to use ROVs.

Frequently, the access platform in an offshore location is a considerable distance from the actual subsea wellhead. The technique which is used to put the well on gas-lift service requires a connection of the gas source from the service platform to the wellhead. It is undesirable to allow liquids to get into this line since, when the well is put in gas-lift operation, the liquids will be displaced into the annulus and have a detrimental effect on downhole gas-lift equipment. Accordingly, one prior way to deal with this problem of liquid accumulating in the gas delivery line prior to connection to the subsea manifold was to put a valve at the manifold end of the gas delivery line and connect the gas delivery line using a diver who would then open the valve manually after connecting the line by inserting the stab. For locations where the manifold is at considerable depths, the use of a diver is impractical.

Another possibility would be to put the valve in the gas delivery line adjacent the stab and try to use the ROV to not only insert the stab but also to operate a valve on the fluid delivery line which comes out transversely from the stab. Because of the necessary configurations, it has not been practical to construct an ROV which has the capabilities of not only inserting the stab, but also operating a valve on an adjacent line.

To address the need for installation of a subsea gas-lift line without the risk of contamination of such line with seawater prior to its connection to the subsea manifold, the apparatus of the present invention has been developed so that the gas-lift line can be securely connected to a subsea manifold, as well as pressure-tested to a certain degree, while at the same time keeping the line free of seawater. This technique is possible without having to needlessly blow fluid through the line to try to keep seawater out of it. Such techniques become unworkable since fluid flow needs to be curtailed as the ROV inserts the stab into the manifold. At that point in time, seawater can back up into stab designs of the prior art. However, with the present invention, the stab and associated gas lines stay clear of liquids until the ROV secures the stab in the subsea manifold.

SUMMARY OF THE INVENTION

A stab for a gas-lift injection line is disclosed which includes a built-in check valve to exclude seawater as the stab is being delivered to the subsea manifold. The check valve can be a spring-loaded poppet which can be pressure-balanced with the surrounding hydrostatic forces, or alternatively, preloaded with the use of a pressurized chamber working in conjunction with a biasing spring to hold the check valve in the closed position during delivery. After insertion of the stab into the subsea manifold, the gas flow begins in the stab, which overcomes the forces of the spring and/or pressurized compartment to push the check valve into the open position to allow gas-lift flow through the manifold and down the annulus into the gas-lift valves in the well. Bypass flow passages are incorporated into the plug to provide an additional force to hold the plug in the open position once the gas-lift pressure is applied so as to prevent chattering of the check valve component in the stab.

DETAILED DESCRIPTION OF THE PREFERRED EMBODIMENT

Figure 1:
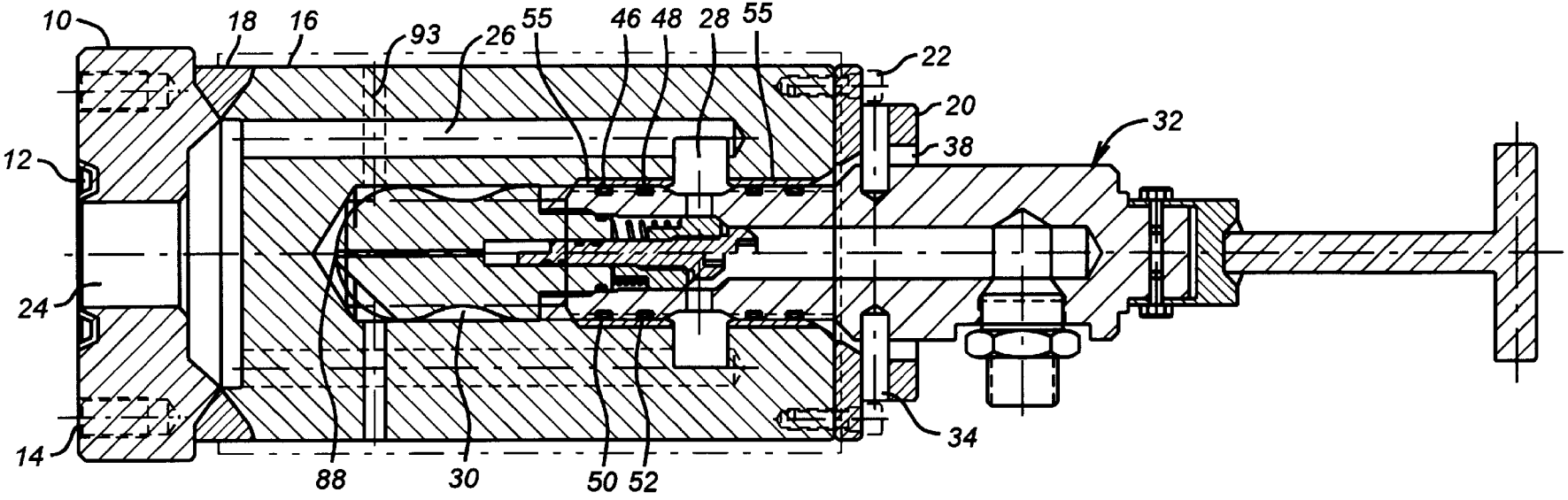
FIG. 1 is a sectional split view showing the stab within the manifold receptacle, with half the view showing the check valve in the closed position and the other half showing the check valve in the open position.
Figure 2:
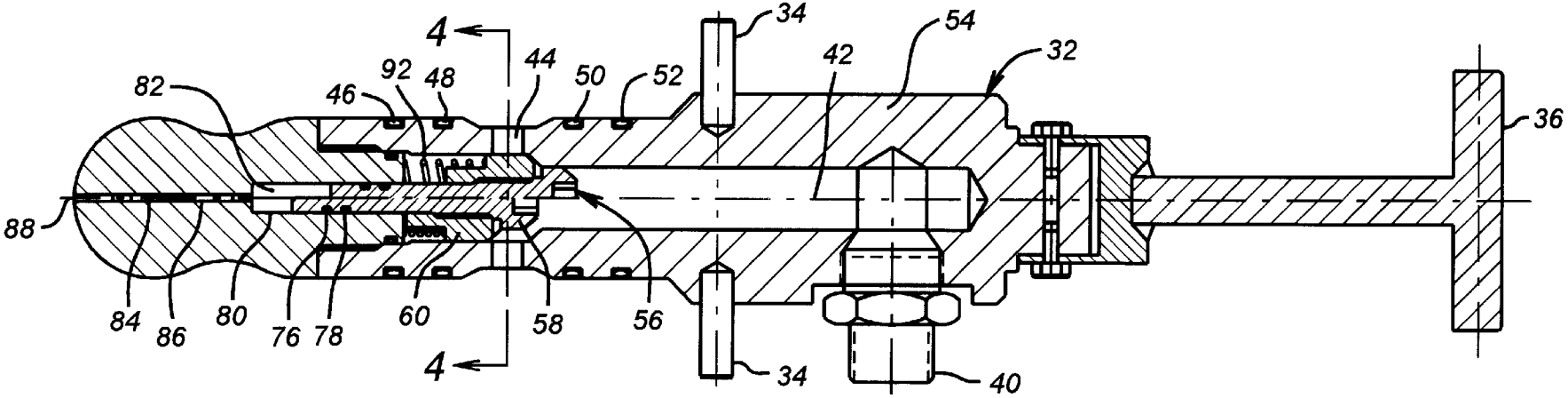
FIG. 2 is a view of the stab of FIG. 1, shown without the manifold.
Figure 4:
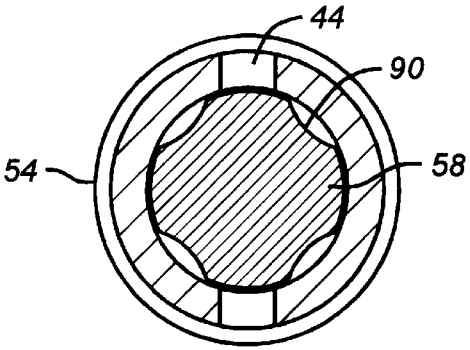
FIG. 4 illustrates a section along lines 4—4 of FIG. 2.

Referring to FIG. 1, a manifold flange 10 is sealingly secured via seal 12 to a subsea manifold (not shown). The flange 10 is secured to the manifold with bolts which extend through threaded openings 14, as well as a mating manifold flange. A receptacle 16 is welded at weld 18 to flange 10. A catch plate 20 is bolted with bolts 22 to the receptacle 16. The receptacle 16 has an outlet 24 for fluid communication into the subsea manifold. Outlet 24 is connected to passages 26, which eventually leads to port 28, which is in communication with chamber 30. Chamber 30 receives the stab 32. Referring to FIG. 2, stab 32 has a pair of opposed pins 34 and a handle 36. Handle 36 is gripped by the ROV for insertion of the stab 32 into chamber 30 of receptacle 16. Pins 34 are able to pass opening 38 in catch plate 20 such that after advancement past opening 38, the stab 32 can be rotated by the ROV to the position shown in FIG. 1 where the pins 34 are captured by the catch plate 20, thus securing the stab 32 to the receptacle 16.

As shown in FIG. 2, the stab 32 has a fitting 40 to which the gas-lift injection line is connected. Valving in this line is not required in view of the construction of the stab 32, as will be explained below. Stab 32 has an internal passage 42 which is in communication with fitting 40. Passage 42 has an outlet 44 which can be one of several in a given transverse plane, as shown in FIG. 2. Stab 32 further has seals 46, 48, 50, and 52 mounted to the body 54 such that seals 46 and 48 are disposed below port 28 when the stab 32 is assembled into the receptacle 16. As shown in FIG. 1, seals 46 and 48 are below port 28, while seals 50 and 52 are above port 28. Included in chamber 30 within receptacle 16 is a polished bore 55 extending below and above port 28 for sealing contact with seals 46–52. Those skilled in the art can see that when pressure is applied from the well access platform (not shown) through a gas-lift line (not shown) connected to fitting 40, the flow is through fitting 40 into passage 42 out through outlets 44 into ports 28, then through passages 26, and ultimately through outlet 24 and into the annular space in the wellbore (not shown).

Figure 3:
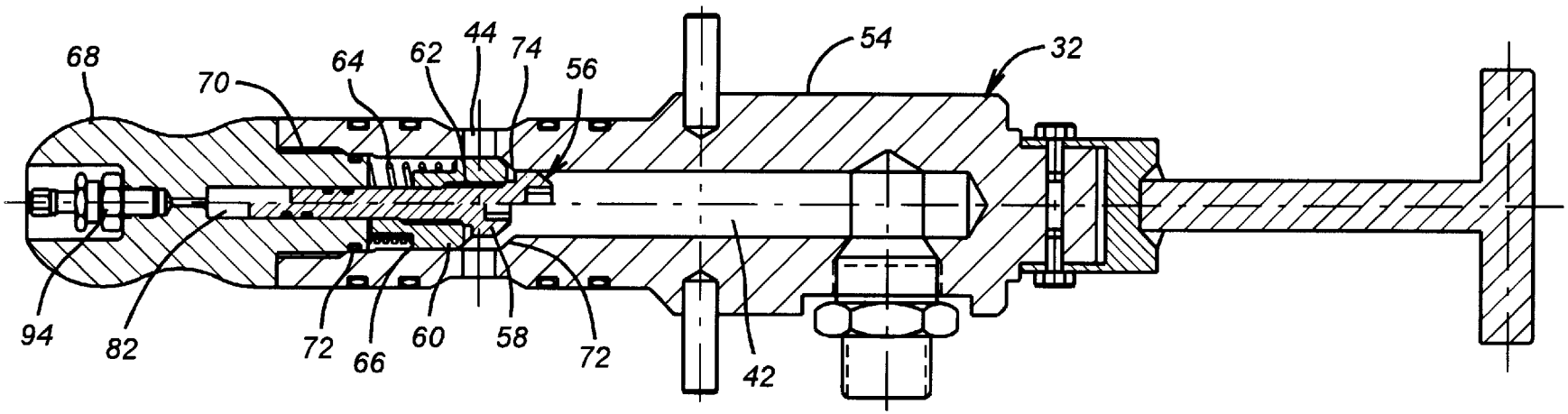
FIG. 3 is a view of an alternative embodiment of the stab of FIG. 2, which can be insertable into the manifold shown in FIG. 1.

Installed within passage 42 is plug 56. Plug 56 is made up of two components, 58 and 60, which are held together by thread 62. A spring 64 bears on shoulder 66, as shown in FIG. 3. The spring 64 can have any desired characteristics depending on the application. The body 54 of the stab 32 is also shown to be constructed in two pieces. The upper part of the body 54 is connected to the lower body 68 by thread 70, with the connection sealed by seal 72. Spring 64 bears on lower body 68 such that it biases the plug 56 toward a seat 72 on upper body component 54. The seal that is formed isolating passage 42 from outlets 44 can be metal-to-metal contact between the plug 56 and the seat 72, or can involve the use of a seal 74 which can be of a suitable material depending on the fluids being handled and the applicable pressures and temperatures. An elastomeric material would be suitable for many applications for seal 74.

Referring to FIG. 2, component 60 of plug 56 has a pair of seals 76 and 78 which seal against annular surface 80, thus defining a cavity 82. A movable barrier material, schematically illustrated as 84, is found in passage 86. The purpose of the barrier material 84 is to prevent seawater from entering cavity 82. The barrier material 84 can be a bellows or a movable piston or any other mechanism that can transmit pressure fluctuations without flow therethrough. Cavity 82 is initially preferably filled with an incompressible fluid. Those skilled in the art will appreciate that in the embodiment shown in FIG. 2, the pressure at outlet 88 equals the pressure at outlet 44. Section 4—4 illustrates the presence of longitudinal flutes 90 along the sides of upper component 58 such that when pressure is applied to fitting 40, compressing the spring 64, and thus moving the plug 56 off of seat 72, the pressure at outlet 44 equals the pressure in cavity 92, where the spring 64 is located such that an additional force is applied to the plug 56 immediately above seals 76 and 78. This pressure applied through flutes 90 helps to hold the plug 56 in an open position to reduce chattering when pressure is applied through fitting 40. It, thus, creates a small unbalanced force as between the pressure in passage 42 and outlet 44, tending to hold the plug 56 open against pressure in cavity 82 transmitted through the barrier material 84 back to outlet 88. Looking at FIG. 1, it can be seen that outlet 88 is in fluid communication with the seawater at depth through openings 93, which extend transversely through the receptacle 16.

The embodiment of FIG. 3 is similar to that of FIG. 2, except that a predetermined pressure can be applied to cavity 82 through a valve 94. The preload pressure that can be applied in cavity 82 acts in conjunction with the spring 64 to hold the plug 56 in the closed position during delivery of the stab 32 by an ROV (not shown).

One of the advantages of having the arrangement as illustrated in the embodiments of FIGS. 2 and 3 is that the line connected to fitting 40 can be pressure-tested without loss of pressurizing fluid if the test pressure is kept to a pressure below which the plug 56 will move off of the seat 72. Additionally, if the line connected to fitting 40 is of the type that cannot withstand excessive differential pressures from outside to inside, the spring 64 or the preload pressure in chamber 82 can be configured to allow internal pressurization of such a line so as to reduce or eliminate the differential pressure across its wall, thus eliminating any danger of collapse from seawater pressure on the outside of the line.

In addition to keeping water out of the gas injection hose, it is desirable to pressurize the hose during installation to avoid collapse due to external hydrostatic subsea pressure (approximately 45 psi per foot-depth). The gas injection hose can be pressurized to equal installation depth pressure before deployment subsea by first charging the stab chamber 82 with a gas to simulate installation pressure on the back side of the check valve. Secondly, charging the hose (not shown) with gas to installation depth pressure so that the force is equal on either side of the check valve except for the spring holding the valve closed. The gas injection hose can now be deployed subsea to required depth without water in the hose or a collapsed hose due to hydrostatic pressure. This scenario is particularly relevant at deeper installation depths where the stab check valve spring 64 alone is not strong enough to withstand the internal hose pressure required to stop hose collapse when applied at the surface prior to deployment.

The configurations as shown in FIGS. 2 or 3 present an improvement in applications of subsea gas lift, allowing, particularly in deep water where use of divers is impractical, an ROV to efficiently install a stab which is preconnected to a fluid line in a manner that precludes the ingress of seawater into the stab or the gas-lift fluid line.

Those skilled in the art will appreciate that the stab 32 of the present invention is substantially in pressure balance with the surrounding seawater when inserted into the manifold 16. Ports 93 assure that the lower end of the stab 32 sees the same pressure at seals 46 and 48 as is seen on seals 50 and 52 through opening 38. The pins 34 merely secure the stab 32 to the manifold 16.

It should be noted that while a spring-loaded plug 56 has been illustrated as the preferred embodiment, other techniques for exclusion of seawater during the delivery of the stab 32 to the manifold receptacle 16 are also within the purview of the invention. The embodiments presented in FIGS. 2 and 3 are preferred, however, due to their simplicity and reliability of operation. Furthermore, these designs illustrated in FIGS. 2 and 3 easily lend themselves to reliable installation with an ROV, while at the same time ensuring that seawater will not get into the line, while at the same time allowing a technique for pressure-testing the line without unseating plug 56 prior to hook-up with the receptacle 16. Thus, if the gas delivery line connected to the fitting 40 has any defects, they can be easily determined with a pressure test prior to insertion of the stab 32. The insertion technique using the apparatus of the present invention also can accommodate a low or no pressure situation within the fluid delivery line connected to fitting 40. Flow through outlets 44 is undesirable as the ROV attempts to insert the stab 32 into the manifold 16.

Accordingly, a reliable and simply constructed design for a stab 32 is presented, which facilitates installation with ROVs for subsea manifolds for wells on gas lift. The designs depicted in FIGS. 2 and 3 can be used for other applications and are not necessarily limited to gas lift.

The foregoing disclosure and description of the invention are illustrative and explanatory thereof, and various changes in the size, shape and materials, as well as in the details of the illustrated construction, may be made without departing from the spirit of the invention.

we claim:

1. A stab for connecting a line from the surface to a subsea manifold receptacle, comprising:

a body having a flowpath extending from an inlet to an outlet;

a valve in said flowpath isolating said outlet from entry of seawater as said body is advanced into said receptacle with the line connected to said inlet.

2. The stab of claim 1, wherein:

said valve further comprises a valve member which is biased toward a seat.

3. The stab of claim 2, wherein:

said valve member is biased toward said seat by a spring.

4. The stab of claim 3, wherein:

said valve member is biased toward said seat by hydraulic pressure.

5. The stab of claim 4, wherein:

said hydraulic pressure on said valve member is applied by a fluid in a chamber defined by said body where said fluid is precharged into said chamber to a given pressure and is in contact with said valve member.

6. The stab of claim 4, wherein:

said hydraulic pressure is provided by surrounding seawater acting on a movable piston, said piston defining a sealed chamber for a fluid which contacts at least a portion of said valve member.

7. The stab of claim 3, wherein:

said spring is mounted in an annular space around said valve member so that it applies a bias force on a shoulder of said valve member, said annular space in fluid communication with said outlet such that pressure at said outlet acts on said valve member in a direction opposite to said spring to minimize chattering of said valve member against said seat after applied pressure at said inlet moves said valve member away from said seat.

8. The stab of claim 7, wherein:

said valve member comprises a sealing surface engageable to said seat; and at least one longitudinal flute to allow pressure at said outlet into said annular space which contains said spring.

9. The stab of claim 8, wherein:

said valve member extends into a chamber defined by said body having a fluid therein which exerts a force on at least a portion of said valve member urging said sealing surface against said seat.

10. The stab of claim 9, wherein:

said fluid in said chamber exposed to surrounding seawater pressure through a moving barrier which isolates the fluid in said chamber from the seawater.

11. The stab of claim 9, wherein:

said fluid in said chamber is inserted therein under a predetermined pressure which acts on at least a portion of said valve member.

12. A method of connecting a line from the surface to a subsea manifold, comprising:

connecting the line to an inlet on a stab;

using a valve in the stab to keep seawater out of an outlet on the stab when said valve is in a closed position;

inserting the stab into the manifold.

13. The method of claim 12, further comprising:

pressurizing the line against said valve when said valve is in the closed position.

14. The method of claim 13, further comprising:

biasing the valve to its closed position.

15. The method of claim 14, further comprising:

using fluid pressure to additionally bias the valve to a closed position.

16. The method of claim 15, further comprising:

trapping pressurized fluid in a chamber exposed to a movable valve member which comprises said valve;

using said fluid pressure to push said valve member toward its closed position.

17. The method of claim 15, further comprising:

providing a chamber in the stab with fluid therein exposed to said valve member;

using the seawater pressure against a movable barrier to exert fluid pressure on the valve member toward its closed position.

18. The method of claim 15, further comprising:

using a spring in an annular space around the valve member to push on a shoulder of the valve member to bias it toward its closed position.

19. The method of claim 18, further comprising:

equalizing pressure at the stab outlet and the annular space, both of which are exposed to the surrounding seawater pressure as said stab is inserted into the manifold; and using said outlet pressure in said annular space to act on said valve member in a direction opposite to said spring to reduce the tendency of said valve member to chatter against a valve seat.

20. The method of claim 19, further comprising:

using at least one longitudinal flute on the valve member as an equalization path between said outlet and said annular space.

21. The method of claim 13, further comprising:

increasing pressure in said line to open said valve to allow fluid communication between said inlet and an outlet on said stab.

* * * * *